United States Patent [19]

Shearon

[11] 4,080,856

[45] Mar. 28, 1978

[54] ROTARY WEB CHOPPER

[75] Inventor: Michael Hillas Shearon, Newark, Del.

[73] Assignee: E. I. Du Pont de Nemours and Company, Wilmington, Del.

[21] Appl. No.: 689,557

[22] Filed: May 24, 1976

Related U.S. Application Data

[63] Continuation of Ser. No. 616,055, Sep. 23, 1975, abandoned.

[51] Int. Cl.[2] ..... B65H 17/20; B26D 7/06

[52] U.S. Cl. ..... 83/99; 83/100; 83/345; 83/694; 83/595

[58] Field of Search ..... 83/99, 345, 356.3, 674, 83/694, 594, 595, 98, 100

[56] References Cited

U.S. PATENT DOCUMENTS

| | | | |
|---|---|---|---|
| 2,786,673 | 3/1957 | Bridenstine | 83/100 |
| 3,143,016 | 8/1964 | Obenshain | 83/694 X |
| 3,338,575 | 8/1967 | Nystrand et al. | 83/100 |
| 3,380,327 | 4/1968 | Stemmler | 83/100 |

*Primary Examiner*—Willie G. Abercrombie

[57] ABSTRACT

An apparatus for the high-speed transverse severing of equi-sized sheets from a running web utilizing interacting blades carried by power-driven counter-rotating shafts, with vacuum retention of the web on one shaft of the apparatus as carrier over substantially from the point of web input to the apparatus to at least the point of web severance.

6 Claims, 17 Drawing Figures

Fig. 3.
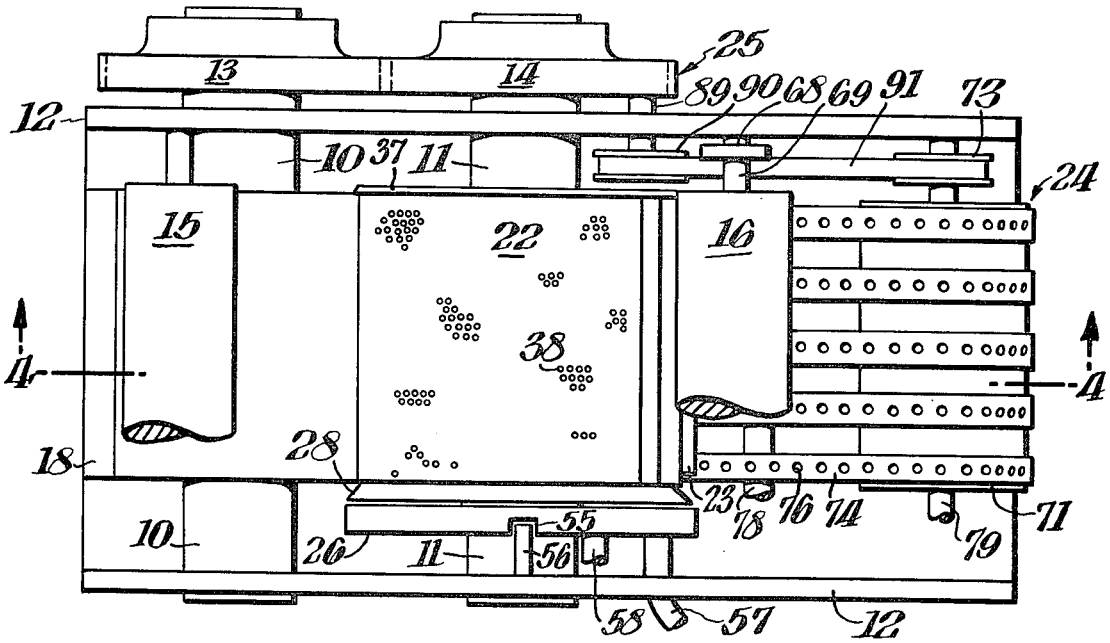
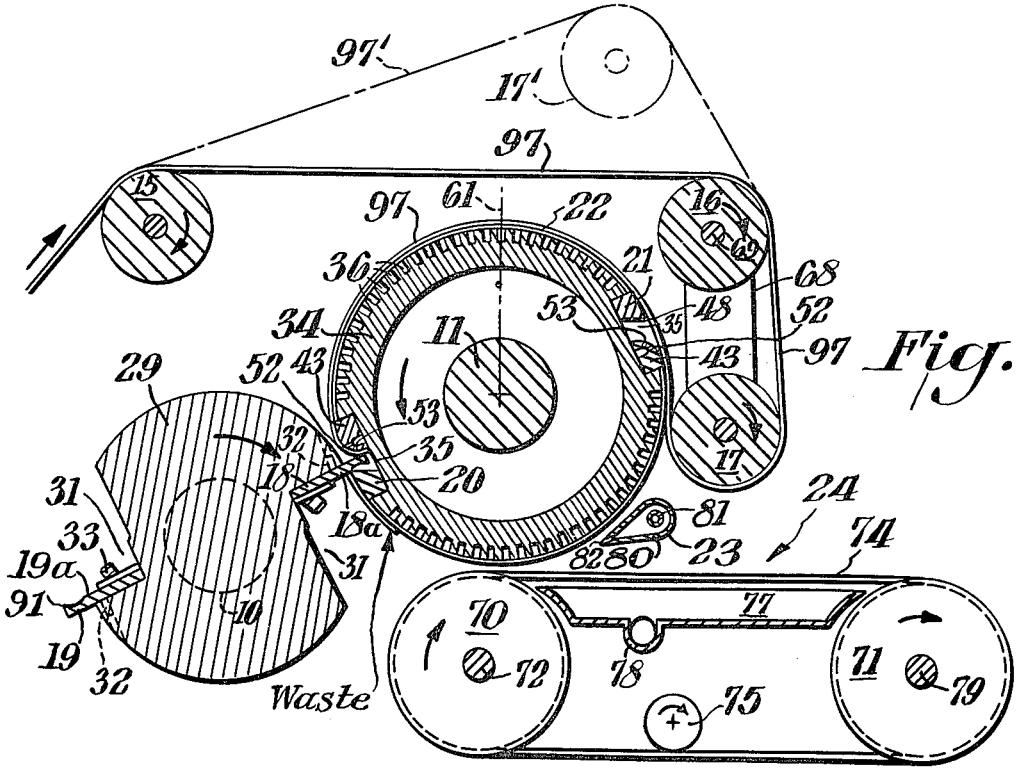
Fig. 4.

Fig. 5.
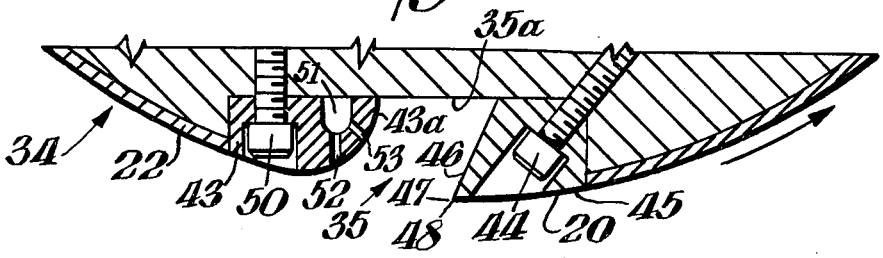
Fig. 7.
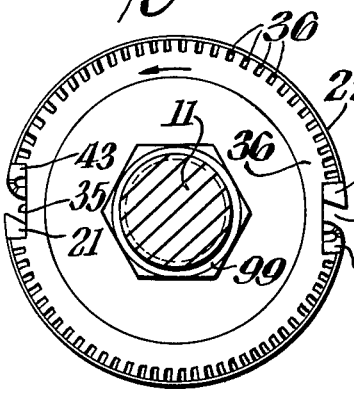
Fig. 6.
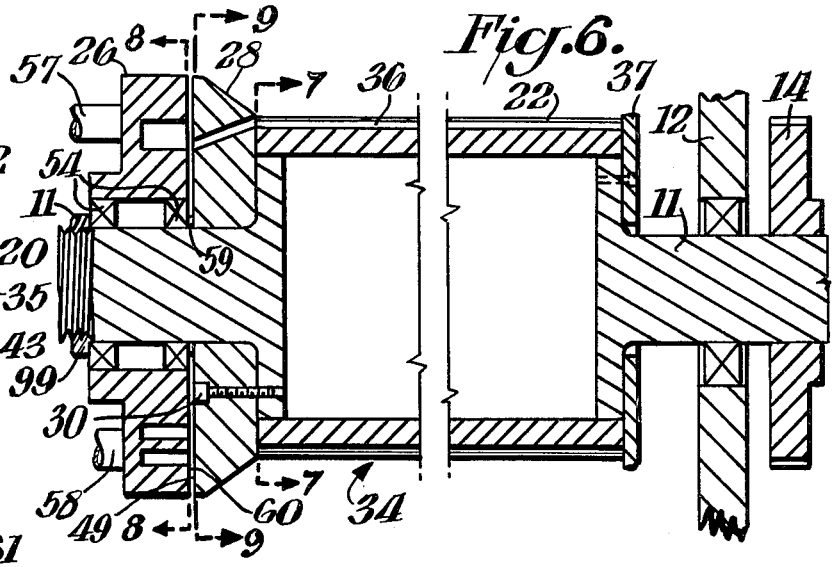
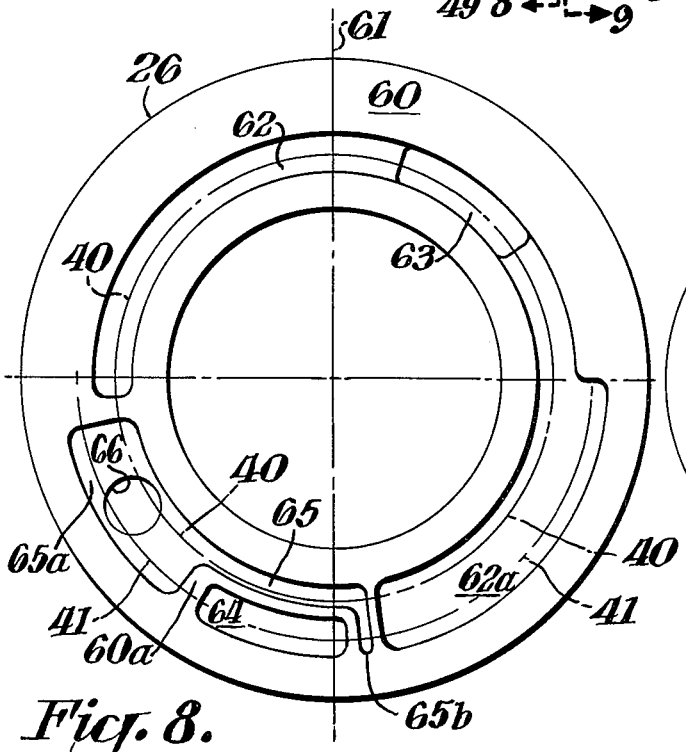
Fig. 8.
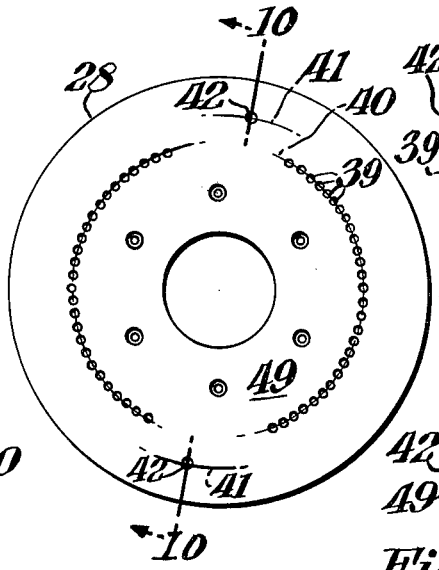
Fig. 9.
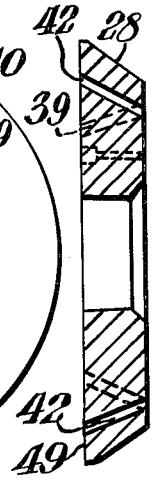
Fig. 10.

ROTARY WEB CHOPPER

This is a continuation of application Ser. No. 616,055, filed Sept. 23, 1975, now abandoned.

BRIEF SUMMARY OF THE INVENTION

Generally, this invention is a shear cutter for a running web comprising a pair of axially co-parallel counter-rotating shafts power driven in synchronism one with the other, the first shaft of the pair being provided with at least one peripheral inwardly extending recess within which is mounted a radially disposed straight-edge blade having a cutting edge located near the outside perimeter of the first shaft, the second shaft of the pair being provided with at least one peripheral inwardly extending recess within which is mounted a blade having a cutting edge located outboard of said shaft and shaped in end cross-section over its full length to a generally epitrochoidal curve, the blades interacting along their opposed cutting edges to effect a shearing cut on a web trained over the periphery of the first shaft during a predetermined angular sweep of the shafts when the blades are in proximity one to the other, and means for selectively retaining the web on said first shaft from substantially the point of web input to the apparatus to at least the point of web severance.

THE DRAWINGS

FIG. 1 is an isometric view, partly in cross-section, of a first preferred embodiment of apparatus according to this invention, FIG. 2 is a diagrammatic view of the power drive train for the apparatus of FIG. 1, FIG. 3 is a plan view of the apparatus of FIG. 1, FIG. 4 is a longitudinal sectional view taken on line 4—4, FIG. 3, FIG. 5 is an enlarged fragmentary cross-section of a straight blade recess of the apparatus of FIG. 1, showing both the blade and the associated vacuum-pressure web leading edge appurtenance, FIG. 6 is a longitudinal section of the upper, web-retaining roll for the apparatus of FIG. 1, FIG. 7 is a transverse end view taken on line 9—9, FIG. 6, FIG. 8 is an end elevation view taken along line 10—10, FIG. 6, FIG. 9 is an end elevation view taken along line 11—11, FIG. 6, FIG. 10 is a vertical section taken along line 12—12, FIG. 9, FIG. 11 is a sectional fragmentary view taken along line 4—4, FIG. 3, wherein the shafts are at a different relative rotational position from FIG. 4 and the scale is somewhat enlarged to show the sheet-stripping air jet auxiliary, FIGS. 12*a*–12*f* are fragmentary cross-sectional views of the interacting cutter blades taken along line 4—4, FIG. 3, showing, in progression, the initiation, continuation and termination of a single web cut.

BACKGROUND

Power-driven counter-rotating opposed rolls provided with interacting blades exist for the severance of a running web fed between the blades in planar form. Where constant angular velocity of the rotating components is maintained, it is possible to obtain a uniform cut length of successive sheets. However, mechanical roll drives inevitably have clearance or slack at various points which contribute mechanical backlash which, when combined with shaft twisting and other structural deformations, results in instantaneous velocity differences at the blade tips which, in turn, gives differences in sheet length of as much as ± 1 mm., which is excessive. Additionally, these effects are influenced by web dynamics, e.g., web flutter and the like, which account for part of the length variation. The effect of web dynamics increases when high web speeds of, for example, 50 meters/min. or higher, are attempted.

A somewhat better approach is to substitute for the planar web feed a cutter in which the running web is wrapped for at least one third of a turn about a roll or shaft carrying one of the two opposed cutting blades and is maintained in wrapped position, as by vacuum applied internally to the roll shell, without relative slippage, web-to-roll right up to the point of severance of the web. Such a cutter produces sheets of very high precision in cut length, e.g., better than plus or minus 0.2 mm. However, yet another problem arises, particularly in high-speed operation; namely, since it is imperative that the web be secured in non-slip relation to one roll, at high speeds it becomes progressively more difficult to effect controlled separation of the newly severed web end from the roll to eject the cut sheet product to a downstream receiver, such as a conveyor. Failure to obtain precisely timed ejection results in web damage, cut sheet jams and other malfunctions requiring shutdown of the cutter, with loss of production or temporary diversion of the oncoming web to waste.

The present invention has for its objective the provision of a cutter operating at very high speed while maintaining highly accurate web severance and trouble-free cut sheet ejection.

DETAILED DESCRIPTION OF A PREFERRED EMBODIMENT OF THE INVENTION

Figure 1:
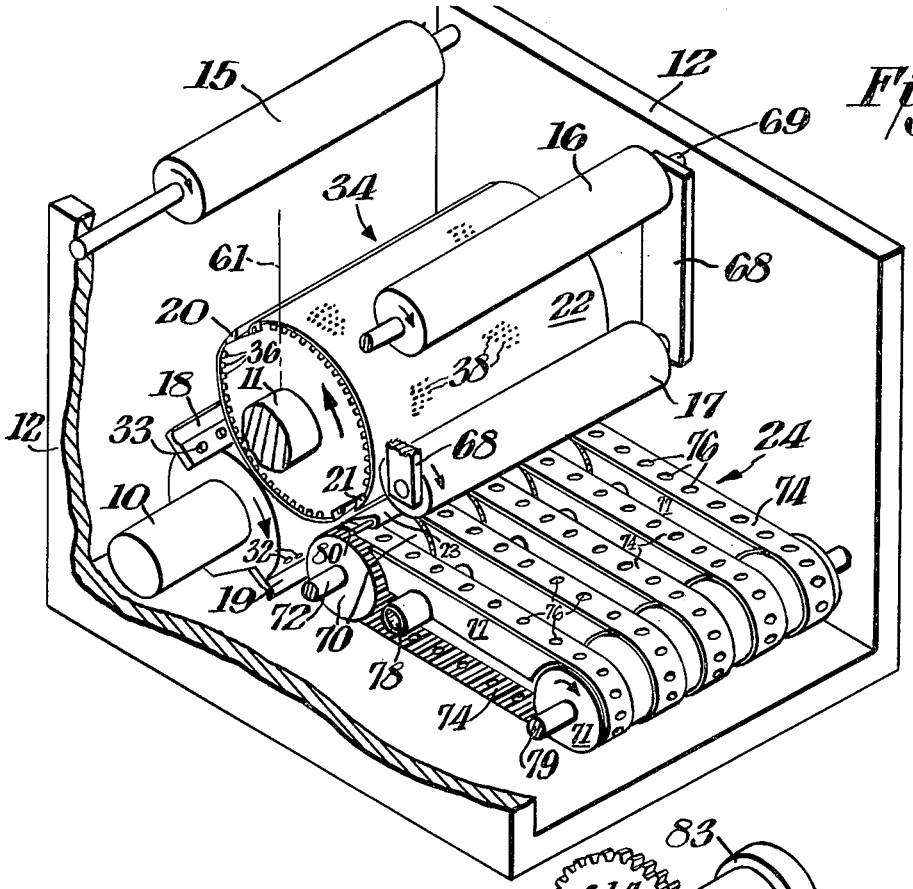

Referring to FIGS. 1, 3 and 4, a preferred embodiment of apparatus according to this invention generally comprises a frame 12 journalled in which, in ball bearings (not shown), is a pair of parallel shafts 10, 11 which are adapted to be driven in synchronism and in opposite sense of rotation by gears 13, 14, respectively. The embodiment further comprises a plurality of web cutting blades 18, 19, 20 and 21 carried by the shafts, a perforated shell 22 on the upper shaft 11, a timing valve 26 (FIG. 3), web guide rolls 15, 16 and 17 carried by the frame 12, an air knife 23, a belt conveyor 24 and a drive 25, all hereinafter described in greater detail.

Shafts and Cutter Blades

Referring to FIG. 4, the lower cutter shaft 10, which is arranged for clockwise rotation, has an integral body 29 which, in this embodiment, has two machined recesses 31, parallel to the shaft axis of rotation and located on opposite sides of the body 29. These are provided to receive the individual cutting blades 18 and 19. The latter are each made of a block of tool steel which extends for the full length of body 29, being secured by a plurality of socket head cap screws 33 set at an angle to urge the blade firmly into the 90° corner of the recess 31. Next to each blade, in the body 29, is a plurality of longitudinally aligned threaded holes equally spaced about 4 cm apart along the full length of the blade, each accommodating a socket head set screw 32 the tip of which rests against the lagging face of the blade for effecting fine blade adjustments. The ends of the blades extend radially outside body 29 and are specially profiled on their leading faces 18*a* and 19*a*, as hereinafter described.

The upper (web-carrying) roll 34, FIGS. 4, 6 and 7, is integral with its shaft 11 and the roll face thereof has substantially the same length as the body 29 of lower shaft 10. Machined into the surface of the roll 34 in the axial direction are two recesses 35 (180° apart) and a plurality of longitudinal shallow grooves 36 equally spaced about 1 cm apart which extend end-to-end of the roll face and occupy the entire cylindrical portion except where the recesses 35 are located. The inboard end of the roll has a thin circular plate 37, secured by screws, to close off the ends of the grooves 36. The outer periphery of roll 34, save for the recesses 35, is covered entirely by a shell 22 about 0.2 cm thick, which is secured to the roll cylindrical surface, e.g., by brazing. The shell has a plurality of holes 38, 0.2 cm diameter, aligned in axial rows spaced in the roll axial direction about 0.3 cm apart, directly over each of the grooves 36.

Transition Plate

Referring to FIGS. 6, 9 and 10, secured to the end of the roll 34 opposite plate 37 is a transition plate 28, which is a disc of frustoconical shape, the small end of which abuts the end of the roll 34, being secured thereto by means of screws 30. In FIG. 9, starting from the large diameter end of the plate 28 on face 49 and located on a base circle 40, 19.3 cm in diameter, is a plurality of vacuum holes 39, 0.6 cm in diameter. These diverge inwardly at an angle, relative to the plate central axis, of about 17°, emerging on the opposite face on a circle of about 21.6 cm diameter, each of which vacuum holes is aligned with a respective groove 36 in roll 34. Since the grooves 36 are not present along each side of the recesses 35, the vacuum holes 39 are likewise omitted from plate 28 in the two recess segments, each of about 45° extent and 180° apart.

Starting again from the face 49 of the plate 28 but situated on a different base circle 41, typically 22.9 cm in diameter, is a pair of holes 42, 0.8 cm diameter which are 180° apart and are located in the 45° segments described supra. These holes 42 converge at an angle of about 19° relative to the plate axis to a base circle 21.6 cm in diameter on the opposite (or small diameter) end of the plate 28, where each communicates with an aperture in a quarter round member 43, hereinafter described.

The transition plate 28 is made of tool steel, hardened to Rockwell C 45 with end faces finished to a flatness within three or four light bands, particularly on the face 49 which is subject to rubbing contact with the end face of a similarly finished timing valve 26, to be described.

Shaft Recess

Returning to the upper roll 34 (FIGS. 4, 5 and 7), this is intended for counterclockwise rotation. The leading end of each recess 35 of the roll is occupied by a tool steel blade 20 (or 21), respectively, while the lagging end of each recess is occupied by a quarter round member 43. Each blade 20, (or 21), shown best in FIG. 5, comprises a full roll length bar, secured to the roll by a plurality of screws 44, angled so as to drive the blade firmly into the leading 90° corner of recess 35. The outer profile 45 of each blade 20, 21 is machined to a radius identical with that of the outside periphery of the roll shell 22, while the exposed blade surface 46 disposed within the recess 35 is angled at 25° (measured in the direction of roll rotation) relative to a roll 34 radius, so that the blade, measured chordally, is wider at the outer surface 45 than at its juncture with the bottom of recess 35. At the intersection of the exposed blade surface 46 and the radiused surface 45 the blade has an extremely narrow flat 47 disposed at 90° to a tangent to surface 45 and only 0.03 cm wide. Blade 20, 21 must present a flawless "dead sharp" edge 48 (or corner) at its intersection with the radiused surface 45. This edge 48 extends for the full axial face width of the roll, must lie in the roll outer cylindrical surface and must be parallel to the axis of rotation of the roll 34, i.e., must be in a radial plane. The edges 48 of the two blades 20, 21 are precisely 180° apart within less than plus or minus 0.0025 cm measured circumferentially of the roll.

Occupying the opposite or lagging side of each recess 35 is a quarter round member 43 spaced about 1.5 cm from the blade 20, 21 and secured by screws 50. The side 43*a* which faces toward surface 46 is profiled to form a quarter circle with a radius of about 1.2 cm while the outer side has a radius substantially identical to and flush with that of the outside of the roll shell 22, the smaller and larger radii of member 43 being faired or blended into each other to form a smooth contour. In the bottom of the member 43 is a U-shaped manifold 51 extending the full length of the member 43. One end of the manifold 51 abuts the plate 37, and consequently, is closed, while the opposite end is aligned with and is open to one of the two holes 42 in the transition plate 28. At the rounded apex of the manifold 51 in a plane perpendicular to the bottom 35*a* of recess 35 is a row of 0.16 cm diameter holes 52 spaced at about 1.2 cm coparallel to the axis of roll 34 and extending practically the full length of the member 43. Aligned angularly with each of the holes 52 are second holes 53 of the same size, the holes 53 being arrayed in a row at 45° to the bottom 35*a* and aimed generally toward the cutting edge 48 of the blade 20, 21. The holes 52, 53 extend entirely through the quarter-round member 43 from the manifold 51 to the radiused surface of the quarter-round.

Timing Valve

Referring to FIGS. 3 and 6, supported on ball bearings 54 on the outboard end of shaft 11, is a timing valve 26. In the upper left outside end of the timing valve 26 is a slot 55 (FIG. 3) engaged by a key 56 secured to the machine frame 12. This key-slot combination is sufficiently loose-fitting to permit the valve 26 to "float" axially, but prevents rotation of the valve. At the upper part of the valve 26 is a vacuum tube 57 (shown fragmentarily in FIG. 3) running to an external source (not shown) of vacuum at about 15 cm Hg below the ambient atmosphere while at the lower part of the valve 26 is a supply tube 58 for furnishing air (from a source not shown) at a pressure of about 1.1 Kg/sq cm. As shown in FIG. 6, a smaller spacer ring 59 on shaft 11 rests against the face of the transition plate 28 as well as the face of one of the bearings 54. Spacer ring 59 has an axial thickness that is preselected to hold the face 60 of the timing valve 26 out of contact with the confronting face of the transition plate 28 by about 0.0025 cm, i.e., enough to allow the transition plate 28 to rotate freely (with roll 34) relative to timing valve 26. Threaded nut 99, screwed onto mating threads on the outboard end of shaft 11, retains plate 26 against excessive movement leftwards, as seen in FIG. 6.

In FIG. 8, the inner face 60 of timing valve 26 is finished to a high degree of planarity and smoothness for possible rubbing contact with the outboard face 49 of transition plate 28 (as described above) with which it mates. Superimposed on the drawing, FIG. 8, are representations of the base circles 40 and 41 (of FIGS. 11 and 12 hereinbefore described) in scale relationship to the valve 26, to be further discussed hereinafter. A vertical line 61 denotes the center of the key 56 which locates valve 26 relative to the frame 12 and this will be used as a zero degree reference infra. It will be understood that the upper roll 34 rotates counterclockwise in the drawings, save for FIG. 8, in which the face 60 of the valve 26 is viewed from the side of the machine opposite to the other FIGURES. (ref., FIG. 6 section planes) in consequence of which the roll 34, although not shown in FIG. 8, would appear to rotate clockwise therein.

As a matter of convenience, angles from 0° to 360° will be taken clockwise (in FIG. 8 only) from the reference line 61. In the face 60 is an arcuate vacuum slot 62, 2.5 cm deep and 1.7 cm wide radially which extends from 265°, through zero, to 170° (i.e., a total extent of 265°). At about the 45° position, an aperture 63, about 35° long, intersects slot 62 and runs entirely through the body of valve 26 communicating on the far side with the vacuum duct 57 (not shown in FIG. 8). Inspection of FIG. 8 shows that the base circle 40 lies over the slot 62. Thus, as roll 34 rotates, any given vacuum hole 39 of transition plate 28 will enter into communication with the vacuum slot 62, turning "on" as the hole crosses 265° and "off" again as the same hole reaches 170°. The angular extent of the slot 62 is, of course, great enough so that a plurality of holes 39 are always exposed to a vacuum condition at any given time. Consequently, a large area of about 265° of the roll shell 22 will be subject to vacuum via grooves 36 and holes 38.

The vacuum slot 62 has an extension 62*a* around a portion of its outer boundary running from 90° to the end of the slot 62 at 170° the radius of which is large enough to coincide with a portion of the base circle 41. Thus, as roll 34 rotates, the two holes 42 of transition plate 28 will be exposed alternately to a vacuum condition each turning "on" at 90° and "off" at 170°. The onset of the vacuum condition at 90° results in an influx of ambient air from a recess 35 to the quarterround member 43 via holes 52 and 53 and thence to manifold 51 and hole 42 (FIG. 10) causing the end of a severed web to enter partly into the recess 35 (in a manner to be described).

Generally, at the bottom of the valve 26 from 178° to 210° is an arcuate pressure slot 64 about 1.7 cm wide radially, but running entirely through the body of valve 26 to connect with the air supply pipe 58 (FIG. 6) on the far side. The base circle 41 may be seen to lie over this slot 64. Thus, at certain times during rotation of roll 34 one of the two holes 42 of transition plate 28 will be uncovered, furnishing air at about 1.1 Kg per sq cm to one hole 42 and thence to the corresponding manifold 51 (FIG. 5) and holes 52, 53 of one quarter-round member 43, which then is turned "on" at 178° and "off" at 210° forming jets of air at holes 52, 53 which issue outwardly into the recess 35.

In FIG. 8, starting at about 173° and running to 260° is an arcuate vent slot 65 about 1 cm wide and 2.5 cm deep, the principal portion of which may be seen to coincide with the base circle 40. An extension 65*a* runs radially outward from the slot from 218° to 260° and, with the principal slot 65, overlies a hole 66 which runs entirely through the body of valve 26 to communicate with the ambient atmosphere. A narrow branch 65*b* (e.g., 0.5 cm wide) extends radially outward at the starting end, 173°, between the terminus of the vacuum slot 62 (at 170°) and the beginning of the pressure slot 64 (at 178°). The outer portion of the branch 65*b* serves to "drain off" (to ambient atmosphere via hole 66) any leaking air which escapes from the pressure slot 64 (at 178°) which would otherwise tend to flow to the vacuum slot 62 between the confronting face 60 of valve 26 and face 49 of plate 28 which, as noted above, may be spaced about 0.0025 cm from each other. If such leakage were permitted to occur directly into the vacuum pump (not shown) via slot 62 there would be required a vacuum pump of greater capacity, thereby increasing costs of operation.

Since slot 65 overlies base circle 40, it serves another function, namely, to permit each hole 39 of transition plate 28 to regain ambient atmospheric pressure after it crosses 170°. This has the effect of relieving vacuum progressively in grooves 36 of roll 34 and thence in holes 38 in shell 22 thereby releasing a web lying thereon. Yet another function is served by the extension 65*a*. Referring to base circle 41 of transition plate 28, as a hole 42 crosses the end of the pressure slot 64 (at 210°), high pressure air is cut off, which halts the jets of air which had been issuing from the holes 52, 53 of quarter-round member 43. If hole 42 or manifold 51 still contains pressurized air, however, this will be "dumped" to the ambient atmosphere as soon as hole 42 clears the land 60*a* and enters the extension 65*a* at 218°.

By definition, the vertical line 61 runs through the center of the roll 34 and the key 56 of the valve 26. This was identified as a zero reference for measuring angles related to the axis of roll 34 and is used again for that purpose in FIGS. 1 and 4, except that, in these views, the angles are measured in the counterclockwise direction (which is also the direction of rotation of the roll in these views). In FIGS. 1 and 4, around the upper portion of the roll 34 are smaller diameter web guide rolls 15, 16 and 17, which are idlers supported by the frame 12 in ball bearings (not shown). Guide roll 15 is located at about 60°, guide roll 16 at 310°, and guide roll 17 at 250°. Roll 17 is situated close to, but out of contact with, roll 34 in order to attain maximum web wrap on the latter.

As shown in FIGS. 1 and 4, guide roll 17 is carried at the outer ends of a pair of arms 68 (only one being shown), which are pivotally mounted on the machine frame 12 by means of a shaft 69, which shaft also carries the guide roll 16. For web thread-up, the guide roll 17 may be swung manually from the "down" position, best seen in FIG. 4, to a position above roll 16, designated 17'. A locking means (not shown) permits the arms to be secured in either position.

Belt Conveyor

Referring now to FIGS. 1, 3 and 4, belt conveyor 24, beneath the roll 34, comprises a plurality of toothed timing belt pulleys 70 secured to a common shaft 72 supported by the machine frame. The axis of the pulleys 70 is located at about 175° relative to roll 34 and their perimeters are spaced about 0.5 cm from the outside periphery of shell 22 encircling roll 34. Spaced horizontally about 30 cm from roll 70 is another set of timing belt pulleys 71 secured on a common shaft 79, also supported by the machine frame. The shaft 79 extends to the inboard side of the frame 12 and carries a toothed pulley 73, shown in FIGS. 2 and 3, which is arranged to be driven by means of a belt and a gear train hereinafter described. Located about centrally between the pulleys 70, 71, inside the lower reach of endless belts 74 wrapped thereabout is a plurality of belt tensioner pulleys 75 (FIG. 4) each of which is mounted on a short swing arm (not shown), being adapted to urge the lower reach of each belt downward to keep the belt tight.

The belts 74 are conventional, endless, toothed timing belts, except that each has a row of 0.4 cm diameter perforations 76 spaced at about 1.5 cm intervals around the entire perimeter of the belt about midway between the belt edges. The outer surface of the belt is covered with soft white cotton cloth (not shown), also perforated in alignment with perforations 76. Under the level upper reach of each belt is a vacuum box 77. The tops of all of the boxes are essentially coplanar and support the belts, and each box top is provided with a slot (not shown) which is aligned with a row of perforations 76. The slots run substantially from pulley 70 to pulley 71 since the ends of the boxes are contoured to fit close to the pulleys. A vacuum manifold 78, parallel to the pulley axes, opens into all of the boxes and extends outside the machine frame to a source of vacuum (not shown). From the foregoing, it will be seen that if any web-form material is brought into proximity with the upper planar perimeter of the belts, e.g., at the 190° position of roll 34, the web will be drawn down firmly to the belts, by the vacuum, and will thereafter be transported by the running belts from left to right, as seen in FIG. 11.

Air Knife (Optional)

Figure 11:
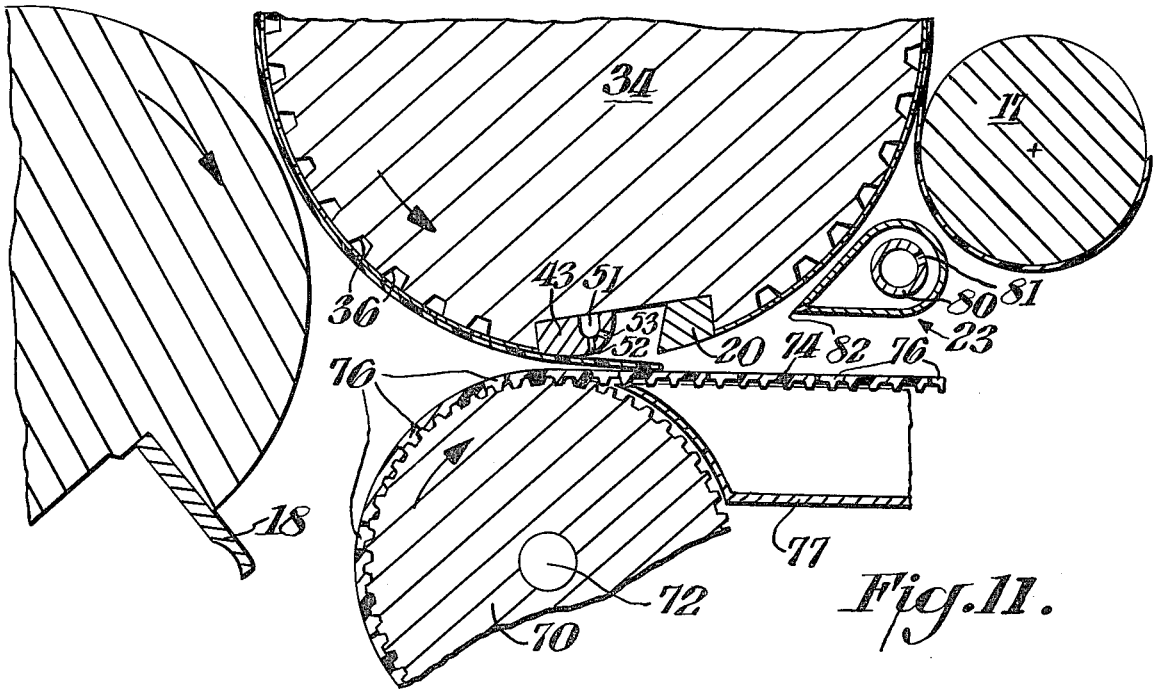

Referring to FIGS. 4 and 11, particularly, at about the 225° position is an air knife 23 made of sheet metal and formed, in cross-section, into a tear drop shape, with the pointed discharge end facing counter to the direction of roll 34 rotation. Concentric with the blunt end portion is a pipe 80 which extends entirely through the air knife and both of its end covers to engage holes (not shown) in the frame 12 for support. One end of pipe 80 is plugged while the other connects to a source of air (not shown) at a gage pressure of 0.2 to 0.3 Kg/sq cm. Inside the body of the air knife the pipe 80 has a row of 17 holes 81 of 0.3 cm diameter spaced about 2.5 cm apart, which open toward the inside surface of the blunt end, assuring uniform air distribution endwise of the air knife. At the pointed end is a row of 70 orifices 82, the axes of which are in a plane generally aligned with the long axis of the tear drop. The orifices are spaced at 0.63 cm and are each 0.16 cm in diameter. Air is fed to the pipe 80 at a rate of about 0.3 to 0.9 $m^3$/min, discharging as jets of air from orifices 82 at a mean velocity of about 4 to 16 m/sec.

As seen in FIG. 11 particularly, one generally flat side of the air knife 23 is spaced about 0.3 cm from the surface of the roll 34, while the pointed end (i.e., the row of orifices 82) is situated at about 218°. Thus, the generally planar array of air columns or jets issuing from the orifices 82 will graze the roll 34 surface generally tangentially at about 206° counter to its direction of rotation.

Drive

Figure 2:
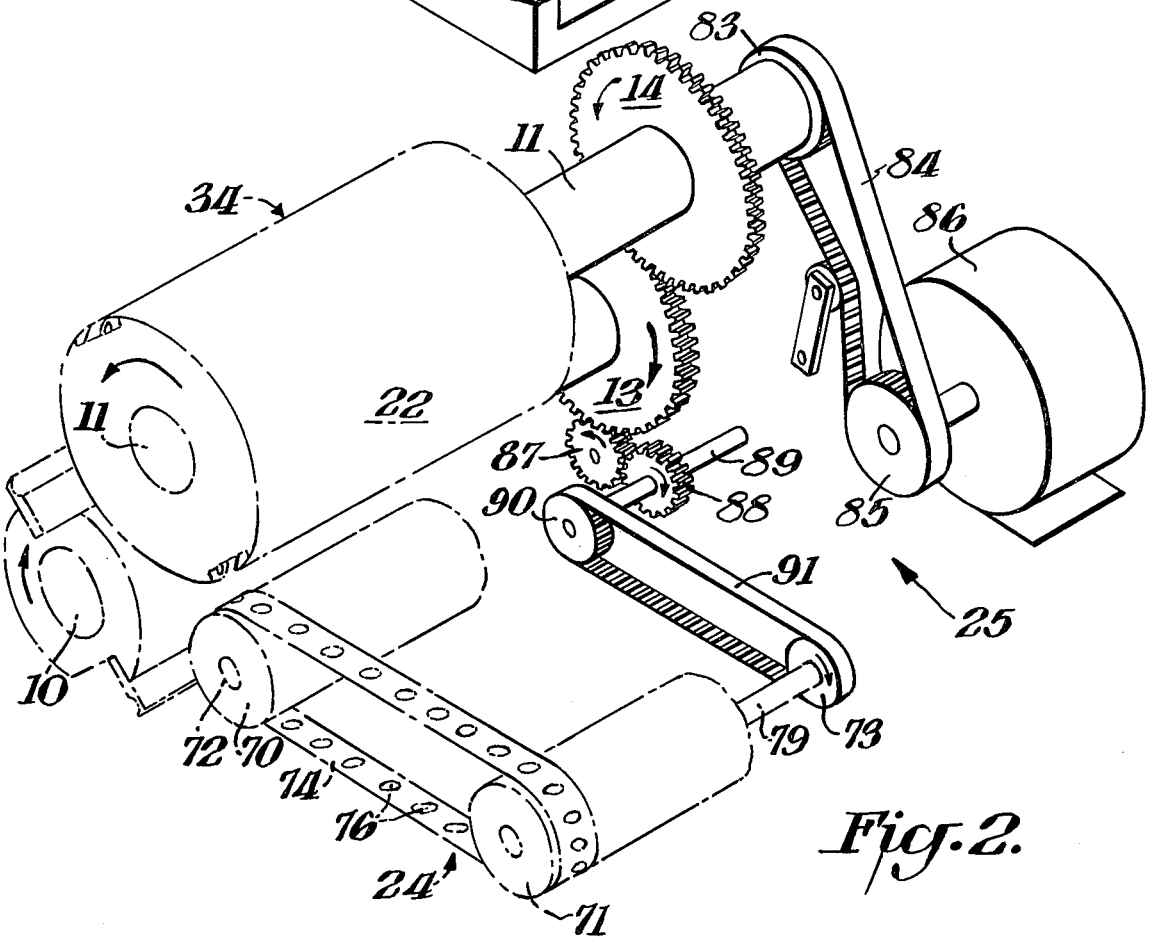

Referring to FIG. 2, the principal parts of the drive 25 comprise mating gears 13 and 14 on shafts 10 and 11, respectively, and a toothed pulley 83 on shaft 11, which is driven by a toothed timing belt 84 from a toothed drive pulley 85 and an electric motor 86. Directly under the gear 13, and engaged therewith, is a small idler gear 87 which is mounted on a shaft which is journalled for rotation in the machine frame (not shown). The gear 87 is engaged with and drives another gear 88 keyed to a shaft 89, which is also journalled in the machine frame. The shaft 89 carries a toothed timing pulley 90, which is keyed thereto and is adapted to drive a timing belt 91, which then drives the toothed pulley 73 attached to shaft 79 thereby effecting the drive of pulleys 71 and belts 74, i.e., belt conveyor 24.

In this embodiment, the gears 13 and 14 have a 1:1 ratio. The remaining gears and belt drives, through the train leading to pulley 73, are preselected and sized to obtain equal surface velocities as regards the outside peripheral surface of shell 22 of upper roll 34 and the outer perimeters of the belts 74 (i.e., belt conveyor 24). Generally these velocities are preferred to be identically equal; however, the belt 74 may be operated from zero difference up to about 1.0% faster than the shell 22. The reverse situation should never prevail; that is, the conveyor belt velocity should not be less than the roll peripheral velocity.

While a 1:1 ratio was described for shafts 10, 11 (and gears 13, 14) other ratios of integers can be used, e.g., 2:1. In this case, shaft 10 would make two turns for each single revolution of shaft 11 and would carry one cutting blade while shaft 11 would carry two.

Thread-Up and Operation

Web-form material in a continuous length is fed (e.g., from a roll, not shown) from the left as viewed in FIGS. 1 and 4 and is threaded up manually. Vacuum is supplied to the upper roll 34 and the belt conveyor 24 by opening valves (not shown) while the movable web guide roll 17 is swung on its arms 68 to the position 17', where it is held momentarily. Referring to the broken-line path 97', FIG. 4, the web end is pulled over guide roll 17, at the moment occupying position 17', then down and under guide roll 16 for approximately 180°. The web leading end is then placed in contact with the outside periphery of the roll shell 22 for a sufficiently large wrap angle, e.g., 30° to 90°, so that vacuum in grooves 36, applied through holes 38, secures the web leading end firmly to the roll. Next, the roll 17 is swung down manually, drawing the web down with it until the roll 17 and its arms reach the solid line or "down" position shown in FIG. 4 where arms and roll are secured by pin locking to frame 12. This action has the effect of increasing the wrap angle of the web on the roll 34 by about 60°, the web now occupying the solid line path 97.

Next, pressurized air is supplied to air knife 23, if one is used, via pipe 80 (by a valve means not shown) and thence to the orifices 82, where plural air streams discharge, generally in a plane to impinge tangentially on the outside periphery of screen 22. Finally, the electrical circuit to motor 86 is closed, starting the entire power train and rolls in motion. As the web is advanced counterclockwise around the roll 34, it reaches a point from about 98° to 108° where the coacting blades sever it. Since the web is secured firmly in non-slip relation to the upper roll 34 for more than 180° of wrap by means of vacuum, and since, in that situation, the web is contiguous with the perimeter of one of the straight-edged blades 20, 21, the edges 48 of which are each aligned parallel to the roll axis, it is clear that the web is severed precisely at 90° to its edge.

The behavior of the web in the region of the recesses 35 is of some importance. As hereinbefore described with reference to FIG. 8, further referred to the rotational convention of FIG. 4, timing valve 26 applies vacuum to manifold 51 in each quarter-round member 43 starting at 95° counterclockwise and remaining "on" to about 170° counterclockwise. Since the plane containing the roll axes is at 116° (refer FIG. 4) and severing starts about 18° in advance of that, it is clear that severing starts at about 98°, or only a few degrees after vacuum was applied to manifold 51. Thus, just prior to being severed, the unsupported span of the web extending across the open recess 35, save for minor air leakage around the two edges of the web, is subjected to a vacuum of about 5 cm of water, which has the effect of bowing the web slightly into the recess.

Figures 12A, 12B, 12C, 12D, 12E, 12F:
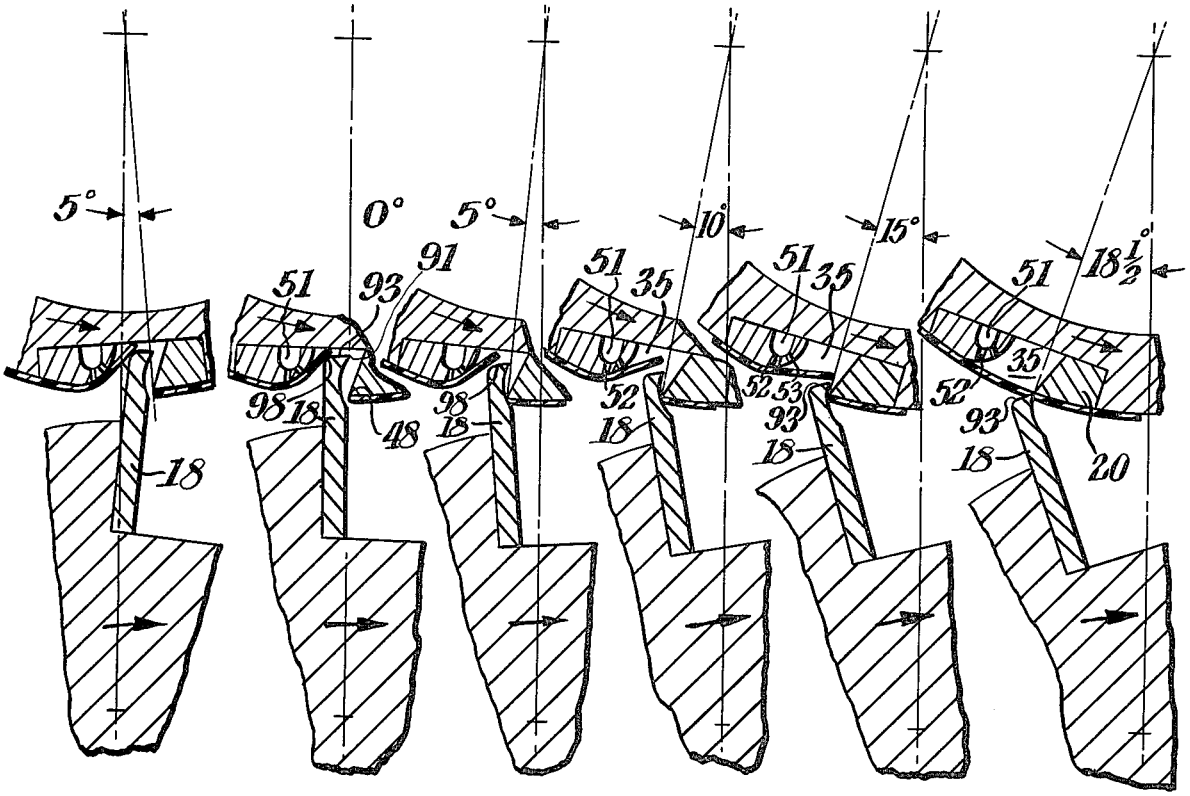

The progressive events of FIGS. 12*a* to 12*f* are referred angularly to the plane containing the roll axes, i.e., the zero degree reference of FIG. 12*e*. Referring to FIGS. 12*a* and 12*b*, as the blade edges start to interengage, say at the near end, the outer surface 93 of the lower blade 18 (also at the near end) will have started to press against the faces of the web, thrusting the newly cut leading end toward the recess 35. As shown in FIG. 12*b*, this bends part of the leading end of the web into abutment with some of the holes 52 at the surface of the quarter-round member 43, in effect permitting vacuum manifold 51 to "grasp" the web. This action continues progressively across the full web width as severing proceeds and has the further effect, when severing is completed, of drawing the entire web leading end well into the recess 35 by bending it partly around the radiused convexity of the quarter-round, the effect being enhanced as the bent web approaches the second row of holes 53 in the quarter-round, which are also subjected to vacuum. This action is advantageous in two respects, in that it draws the web leading end away from and out of contact with the outer surface 93 of the lower blade and also protects the web leading end, FIG. 12*c*, from aerodynamic wedging effects which might otherwise tend to lift the end away from the upper shaft 11 prematurely.

As severing of the web is completed (refer FIGS. 12*c* and 12*d*), the lower blade 18 penetrates more deeply into the recess 35, reaching maximum penetration when the blade edges 48 and 91 are in the common plane of the shaft axes, FIG. 12*e*. At this stage, despite the fact that the web end has been drawn deeply into the recess 35, the blade outer surface 93 again comes into contact with the web face. However, this contact occurs only in the very narrow (about 0.3 cm wide) portion of the web nearest the cut edge. Thus, if scratching of the web or other damage occurs due to this contact, it is in an area of the web not likely to be of use in any event and is confined to a very narrow band. The rubbing effect is further minimized by providing a radius 98 on the heel or trailing side of the blades 18, 19 so that the contact nearly becomes a rolling action. The radius 98 is preferably polished to a smooth finish and, if desired, may be covered throughout the entire blade width with a thin piece of felt (not shown).

As rotation of the shafts continues, FIG. 12*f*, the blade 18 starts to withdraw from the recess 35, losing contact with the web end once again. The web leading end remains bent into the recess under the influence of the vacuum in manifold 51 until the center line (not shown) of the manifold 51 reaches 170° counterclockwise, at which point the vacuum therein is relieved by reason of the crossing of hole 42 in transition plate 28 past the end of the vent slot extension 62*a* in timing valve 26 followed, in about three degrees of shaft rotation, by restoration of ambient pressure in manifold 51 as its corresponding hole 42 reaches slot branch 65*b*.

Yet another 5° of shaft rotation permits the hole 42 to communicate with pressurized slot 64 in the timing valve 26, having the effect of admitting pressurized air to the manifold 51. This produces jet streams discharging from the holes 52 and 53 which lift the leading web end until, at about 192° counterclockwise, the severed edge projects from the outer surface 45 of the blades 20, 21 by about 0.1 to 0.4 cm. At this stage, if an air knife is utilized, the severed leading edge encounters the directly opposing jet streams from the orifices 82 of the air knife 23, as shown in FIG. 11, with the effect that the web leading end is forcibly stripped from the roll 34. Vacuum in grooves 36 having been relieved progressively, the web is deflected into a generally horizontal path and thus into contact with the horizontal reach of the belts 74. Here the vacuum of boxes 77 is able to act, through perforations 76, to hold the web tightly in engagement with the running belts, which then transport the cut web out of the apparatus and into another, such as a cut sheet stacker, not shown.

The apparatus hereinbefore described had the following dimensions for the production of a severed sheet product 35.3 cm long (measured in the direction normal to the roll axes) × 43.2 cm axially of the rolls. The shell 22 diameter was 22.5 cm and the roll 34 length was 50.8 cm, measured axially. The perforated expanse of roll 34 was disposed centrally of shell 22 and measured 40.8 cm in an axial direction, so that the web in process overlapped all holes 38 by about 1.2 cm along each edge. The diameter of the associated roll 29 was 19.0 cm.

The described apparatus was tested in the continuous cutting of a polyester (i.e., polyethylene terephthalate) web 0.018 cm thick supplied at a running web speed of 100 m/min. and was found to produce a high accuracy square cut, particularly as regarded consistent product length, with trouble-free sustained operation.

In the appended claims, the apparatus is defined in terms of the two interacting shafts 10 and 11, it being understood that the integral enlargements of coacting components comprising the outside diameters of shell 22 and the body 29 of the lower shaft are, of course, intended to be understood as incorporated in the shaft diameters per se. The "control means" specified in the claims is intended to comprise timing valve 26, whereas the "means responsive to the control means" comprise the vacuum and air pressure supply systems effecting the actual operation with respect to the web.

I claim:

1. A shear cutter for a running web comprising:

a pair of axially co-parallel counter rotating shafts power driven in synchronism one with the other; said web being trained over said first shaft, said shafts having interacting blades for cutting said web, the first shaft of said pair being provided over a major expanse of its periphery with a multiplicity of web retaining vacuum ports and at least one peripheral inwardly extending recess within which is mounted a first of said blades, said first blade being a radially disposed straight edge blade having a cutting edge located near the outside perimeter of said first shaft;

control means operating in a predetermined time sequence relative to the rotation of said shafts repetitively imposing preselected time durations for vacuum web retention;

means mounted within said recess and responsive to said control means for effecting, in seriatim, vacuum retention of the leading edge of said web during and after severance thereof, followed by means relieving said vacuum retention proximal to said leading edge following each said cut, thereby to release said leading edge; and means stripping said leading edge at a preselected delivery point for severed sheets of said web.

2. The apparatus of claim 1 in which said control means further includes means for effecting the ejection of said running web from said first shaft following release of said running web.

3. A shear cutter for a running web according to claim 2 wherein said web ejection means comprises outwardly directed jets through which pressurized air is discharged against the underside of said web leading edge during a preselected portion of the rotational cycle of said shafts.

4. A shear cutter for a running web according to claim 1 in which said means for stripping said leading edge of said web at said preselected delivery point for severed sheets comprises air jets trained to direct air to the underside of said leading edge.

5. A shear cutter for a running web according to claim 2 wherein said means for effecting, in seriatim, said vacuum retention, release, and stripping of the leading edge of said web comprises a manifold disposed in each said first shaft recess opening into a plurality of orifices, the axes of said orifices being directed outward, with inlet and outlet ports aligned generally parallel to said straightedge blade cutting edge, and means supplying pressurized air to said manifold.

6. A shear cutter for a running web according to claim 5 in which said air jets additionally comprise a fixed air knife jet means located proximal to said first shaft periphery, in the vicinity of said delivery point, said knife being provided with a plurality of orifices aligned generally tangential to said first shaft periphery and directed opposite to the shaft sense of rotation, and means supplying pressurized air to said orifices to assist in lifting said severed leading web end from said periphery.

* * * * *